US006315312B1

(12) United States Patent
Reyes et al.

(10) Patent No.: US 6,315,312 B1
(45) Date of Patent: Nov. 13, 2001

(54) TRUCK FOR A SKATEBOARD

(76) Inventors: Juan L. Reyes, 26212 Via Canon, Capistrano Beach, CA (US) 92624; Bradford E. Horn, P.O. Box 3778, Dana Point, CA (US) 92629

( * ) Notice: Subject to any disclaimer, the term of this patent is extended or adjusted under 35 U.S.C. 154(b) by 0 days.

(21) Appl. No.: 09/428,117

(22) Filed: Oct. 27, 1999

(51) Int. Cl.[7] ..... B62M 1/00

(52) U.S. Cl. ..... 280/87.042; 280/11.27; 280/11.28

(58) Field of Search ..... 280/11.28, 11.27, 280/11.21, 11.26, 87.042, 87.041; 188/21, 22, 60, 31

(56) References Cited

U.S. PATENT DOCUMENTS

| | | | |
|---|---|---|---|
| 2,763,490 | 9/1956 | Crone . | |
| 3,235,282 | 2/1966 | Bostick . | |
| 4,047,725 | 9/1977 | Pinchock . | |
| 4,071,256 | 1/1978 | Kimmell . | |
| 4,120,508 | 10/1978 | Brown et al. . | |
| 4,398,734 | 8/1983 | Barnard . | |
| 4,898,398 | 2/1990 | Cassel . | |
| 5,052,702 | 10/1991 | Chan . | |
| 5,169,166 | 12/1992 | Brooks . | |
| 5,232,235 | 8/1993 | Brooks . | |
| 5,330,214 | 7/1994 | Brooks et al. . | |
| 5,372,384 | 12/1994 | Smith . | |
| 5,458,351 | 10/1995 | Yu . | |
| 5,522,620 | 6/1996 | Pracas . | |
| 5,853,182 | 12/1998 | Finkle . | |
| 5,879,013 * | 3/1999 | Shih | 280/11.28 |
| 5,971,411 * | 10/1999 | Jones et al. | 280/87.042 |
| 5,975,546 * | 11/1999 | Strand | 280/87.042 |
| 6,056,302 * | 5/2000 | Smith | 280/87.042 |

* cited by examiner

*Primary Examiner*—Brian L. Johnson
*Assistant Examiner*—Tony Winner

(57) ABSTRACT

A truck assembly including a housing adapted to be mounted to a skateboard or the like. An axle bracket is positioned partially in the housing and is mounted for rotation transverse to the longitudinal axis. The axle bracket includes a projecting upper end portion and a bottom end portion adapted to receive a transversely extending axle and wheel assembly. A resilient member, located at least partially in the housing, is provided and is adapted to resist transverse rotation of the axle bracket, and provide a restoring force. In addition, a wedge member is provided, having an aperture configured for receiving the projecting upper end portion of the axle bracket to establish a direct coupling therebetween. For example, the wedge member aperture and the projecting upper end portion of the axle bracket may have complementary, engaging polygonal configurations. The truck assembly may further include a rotational lock subassembly structured to prevent wheel bind during a rider effected turn of the skateboard.

21 Claims, 3 Drawing Sheets

TRUCK FOR A SKATEBOARD

BACKGROUND OF THE INVENTION

The present invention generally relates to truck assemblies, and more specifically relates to truck assemblies for skateboards or the like.

Skateboards have now been in use for many years both recreationally and in professional competitive events. So called "longboard" skateboards are a more recent addition to the growing number of skateboard styles. "Longboard" skateboards, having lengths of in excess of thirty six inches, are substantially longer than more common, traditional skateboards, and as can be appreciated, require different skills to master. In addition, conventional skateboard trucks, which were developed for boards of only about two feet in length, may be inadequate for use on longboards. Prior to development of the present invention, there has been no truck assembly which has adequately addressed such problems as "wheel bind" of which longboards are particularly susceptible. Wheel bind occurs when a rider attempts to turn the board by leaning on one side thereof, and the wheel axle is pivoted too far, causing the wheel axle to bind and not be smoothly restored.

Conventional skateboard trucks may include a rubber cushion intended to provide a restoring force to the truck when a user of the skateboard effects a turn by shifting his weight. Kimmell U.S. Pat. No. 4,071,256, the disclosure of which is incorporated in its entirety herein by reference, discloses a skateboard truck which includes such a cushion. One problem with the Kimmell truck is the inclusion of a mounting or king pin which is rigidly coupled to, and forced to rotate with, the trunnion or axle housing. This places the pin under a substantial amount of stress which can reduce the useful life of the truck.

There continues to be a need for new skateboard truck assemblies, for example, which address turning problems such as are encountered with longboards and/or reduce stress on one or more components of the truck. It is noted, however, that the present invention offers substantial advantages when used with traditional skateboards as well.

SUMMARY OF THE INVENTION

New truck assemblies, for use with a skateboard for example, have been discovered. The present assemblies are straightforward in design and offer significant benefits over conventional truck designs, for example, in terms of increased turning response and/or reduced wear and stress on truck components, as well as other advantages.

In one broad aspect, the truck assemblies in accordance with the present invention comprise a housing having a longitudinal axis, an upper end and a bottom end. The upper end is adapted to be mounted, for example, removably fastened using conventional fasteners, to a skateboard or the like. An axle bracket, partially positioned in the housing and extending outwardly from the bottom end of the housing for rotation transverse to the longitudinal axis, is provided. The axle bracket generally includes a projecting upper end portion, as well as a bottom end portion adapted to receive a transversely extending axle and wheel assembly. A mounting pin subassembly operatively coupled to the housing may be, and preferably is, adapted for securing the housing to the axle bracket.

The skateboard truck further comprises a resilient member, for example, a resilient cushion, located at least partially in the housing and adapted to resist transverse rotation of the axle bracket during a turn being effected by a skateboard rider. The resilient member preferably functions to provide a restoring force after a turn is effected by a rider.

Importantly, the truck additionally comprises a wedge member having an aperture configured for receiving the projecting upper end portion of the axle bracket.

Advantageously, as will be explained in detail hereinafter, the wedge member is configured to be directly coupled to the projecting upper portion of the axle bracket, thus providing a substantially rigid engagement therebetween. Preferably, the wedge member aperture and the projecting upper end portion of the axle bracket have complementary, engaging configurations.

The wedge member is disposed at least partially in the resilient member. More specifically, the wedge member may include diametrical flanges adapted to engage complementary diametrical slots in the resilient member, and facilitate proper alignment between the resilient member and the axle bracket.

The mounting pin subassembly preferably includes a mounting pin, for example, an elongated mounting pin, extending substantially along the longitudinal axis of the housing, and a plate member through which the mounting pin passes. The plate member advantageously is adapted to be substantially stationary relative to the housing. In one embodiment, the plate member includes at least one notch, preferably two spaced-apart notches, and the housing includes at least one inwardly extending rib, preferably two spaced-apart inwardly extending ribs, sized and adapted to be received in the notch or notches to maintain the plate member substantially stationary relative to the housing. The plate member preferably has a hole through which the mounting pin passes. The hole and at least a portion of the mounting pin, more preferably the portion of the mounting pin near the upper end of the mounting pin, have complementary engaging configurations to prevent the mounting pin from rotating relative to the plate member.

Preferably, the mounting pin is spaced-apart from the inner wall of the wedge member. The mounting pin subassembly provides for alignment of the components. Unlike prior skateboard truck designs, the mounting pin in the present invention is not subjected to significant stresses, for example, resulting from the transverse rotation of the axle or axle bracket.

In one aspect of the invention, the truck assembly further comprises a rotational lock subassembly adapted to restrain the axle bracket from transverse rotation in excess of a predetermined angle of rotation, for example, an angle of about 21°. Preferably, the rotational lock subassembly includes a notch in the axle bracket and a projecting portion of said housing adapted to be placed in the notch, wherein the projecting portion of the housing limits the rotational movement of the axle bracket to an angle defined by the notch.

Any and all features described herein and combinations of such features are included within the scope of the present invention provided that the features of any such combination are not mutually inconsistent.

These and other aspects and advantages of the present invention are apparent in the following detailed description and claims, particularly when considered in conjunction with the accompanying drawings in which like parts bear like reference numerals.

DETAILED DESCRIPTION

Figure 1:
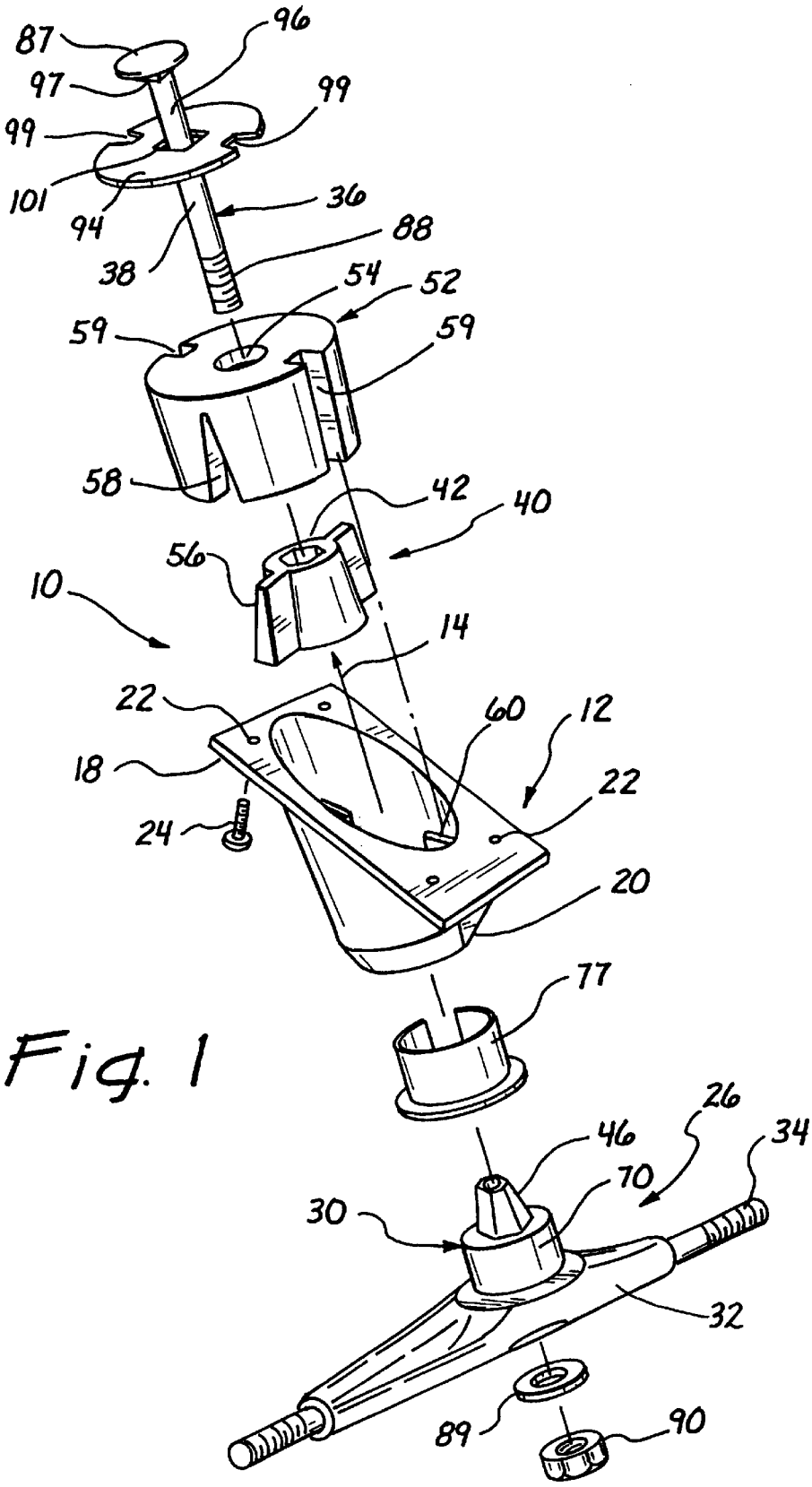
FIG. 1 is an exploded view of a truck assembly in accordance with the present invention, including a housing adapted to be mounted to a skateboard and an axle bracket adapted to receive an axle and wheel assembly.

Turning now to FIG. 1, a truck assembly in accordance with the invention, is shown generally at 10. The truck assembly 10 generally comprises a housing 12 having a longitudinal axis 14, a flanged upper end 18 and a substantially open bottom end 20. The upper end 18 is preferably adapted to be mounted to a skateboard, or the like (not shown in FIG. 1), for example by means of apertures 22 for receiving screws 24 or like fastening devices. In addition, an axle bracket 26, positioned in the housing 12 and extending outwardly from the bottom end 20 of the housing 12 for rotation transverse to the longitudinal axis, is provided.

Figure 2:
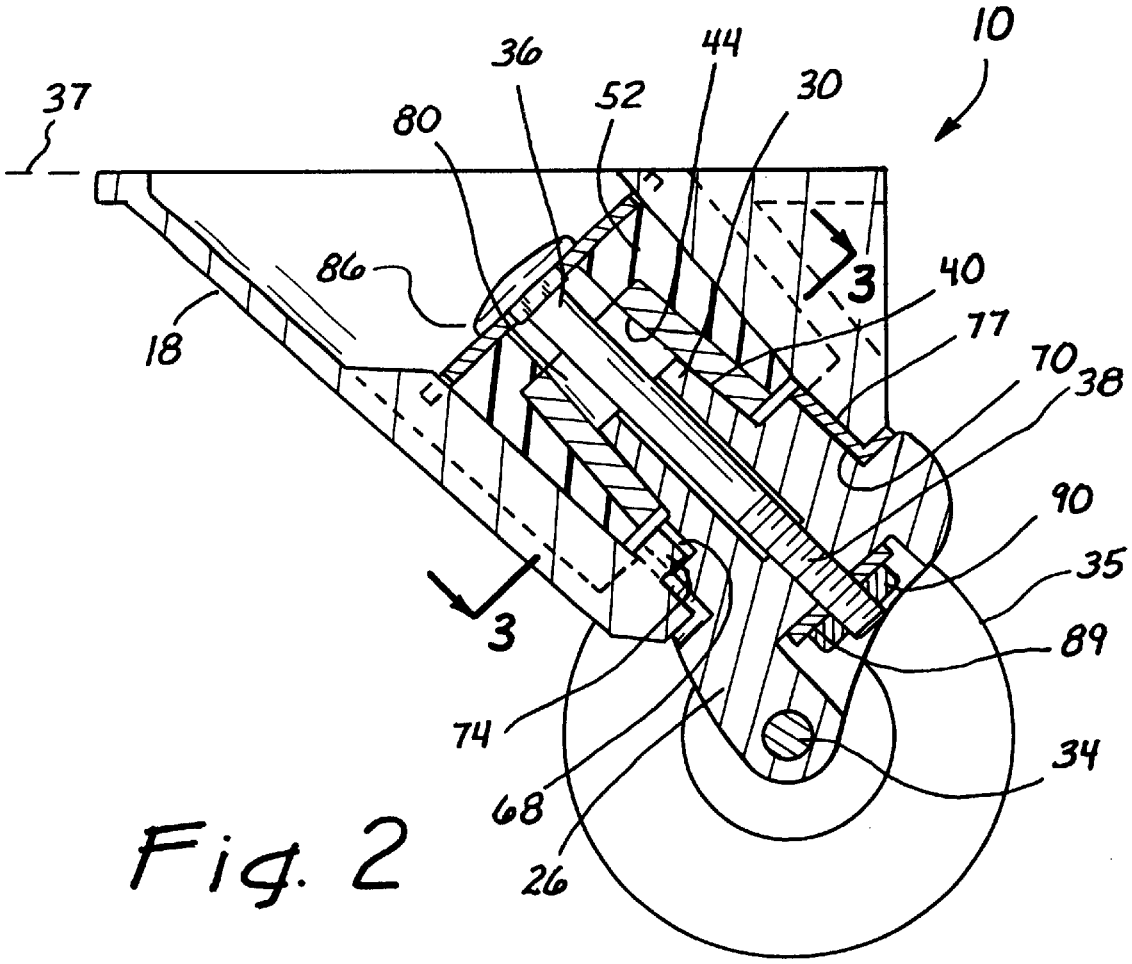
FIG. 2 is a cross sectional view of the truck assembly, showing a rotational lock subassembly for preventing transverse rotation of the axle bracket in excess of a predetermined angle of rotation.

The axle bracket 26 generally includes a projecting upper end portion 30, as well as a bottom end portion 32 adapted to receive a transversely extending axle 34 and wheel assembly 35 (FIG. 2). A mounting or king pin subassembly 36, including a mounting pin 38 extending substantially along the longitudinal axis 14 of the housing 12, may be provided for securing the housing 12 to the axle bracket 26. The housing 12 of the truck assembly 10 is preferably configured such that it will assume about a 45° angle with respect to the plane of the skateboard, shown as phantom line 37.

Importantly, the truck assembly 10 additionally comprises a wedge member 40 made of a suitable material, such as a metal, for example, aluminum, or a rigid plastic or the like substantially rigid material, and having an aperture 42 configured for receiving the projecting upper end portion 30 of the axle bracket 26. Preferably, the wedge member aperture 42 and the projecting upper end portion 30 of the axle bracket 26 have complementary, engaging configurations, for example, such configurations which have complementary tapers. The engaging configurations preferably have at least one substantially planar region, and more preferably are substantially polygonal, that is are made up of three or more substantially planar regions. Such substantially planar or flat region or regions facilitate proper alignment of the wedge member 40 and the axle bracket 26 relative to the housing 12. In the example shown, the configurations are substantially hexagonal, in particular with complementary tapers. More specifically, as shown more clearly in FIGS. 2 and 3, the aperture 42 may be defined by a somewhat conical inner wall of the wedge member 40 having a tapered hexagonal cross section. Referring as well now to FIG. 1, the projecting upper end portion 30 of the axle bracket 26 may include a complementary, hexagonal tapering projection 46 configured to engage the hexagonal aperture 42. It is to be appreciated that although a hexagonal configuration is shown and has been described, the aperture 42 and projection 46 may take other configurations, for example, other polygonal configurations, as well.

Advantageously, the direct coupling between the wedge member 40 and the projecting upper portion 30 of the axle bracket 26 provides a substantially rigid engagement therebetween that resists twisting or contortion about the longitudinal axis. As will be described in greater detail hereinafter, the coupling also facilitates proper alignment and reduces stress on the truck assembly.

The skateboard truck assembly 10 further comprises a resilient member 52, for example, a resilient cushion made of rubber, polyurethane, or other suitable material. Polyurethane is the preferred material of construction for resilient member 52. The resilient member 52 is generally annular in cross section, with the inner opening 54 thereof having a diameter sufficient to receive the wedge member 40 therein. The wedge member 40 is disposed at least partially in the resilient member 52. More specifically, the wedge member 40 includes diametrical flanges 56 adapted to engage complementary diametrical slots 58 in the resilient member 52, and facilitate proper alignment between the resilient member 52, wedge member 40 and the axle bracket 26. The engaging flanges 56 and slots 58 preferably are positioned substantially parallel to the longitudinal axis 14. Longitudinal grooves 59 are provided in the resilient member 52 to engage ribs 60 within the housing (see also FIG. 4).

The resilient member 52 is adapted to resist transverse rotation of the axle bracket 26 during a turn of the skateboard, for example, being effected by a skateboard rider. In addition, the resilient member 52 functions to provide a restoring force after such a turn. Such restoring force is effective in causing the skateboard to resume a level position. Cooperation between the resilient member 52 and the rigid, engaging wedge member 40 operates to linearize the restoring force and improve the ride and "feel" of the skateboard.

It is also noted that the complementary polygonal configurations between the axle bracket 26 and the wedge aperture 42 as well as the diametrically disposed flanges 56 on the wedge member 40 facilitate proper, e.g., aligned, assembly of the present apparatus and, in addition, facilitate maintaining the apparatus in the intended alignment during use.

In one important aspect of the invention, shown most clearly in FIGS. 2, 4, 5 and 6, the truck assembly 10 may further comprises a rotational lock subassembly, shown generally at 66, adapted to restrain the axle bracket 26 from transverse rotation in excess of a predetermined angle of rotation, for example, an angle of rotation in excess of about 25° or about 30°.

Figure 4:
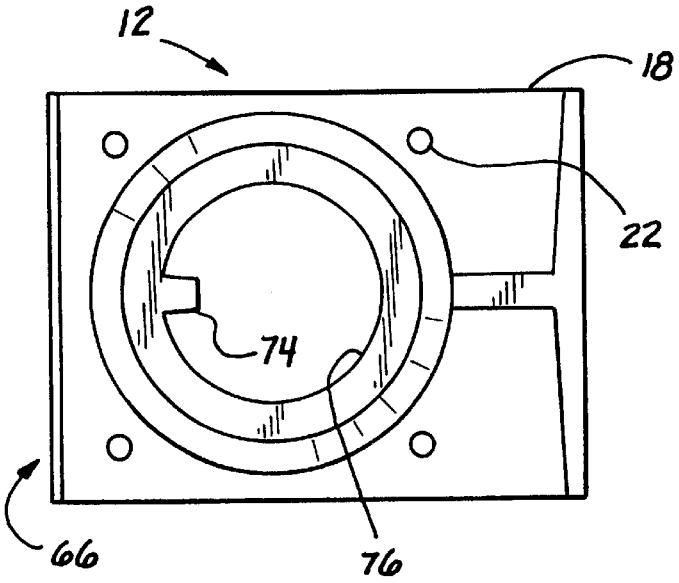
FIG. 4 is a bottom view of the housing of the truck assembly of the present invention.
Figure 5:
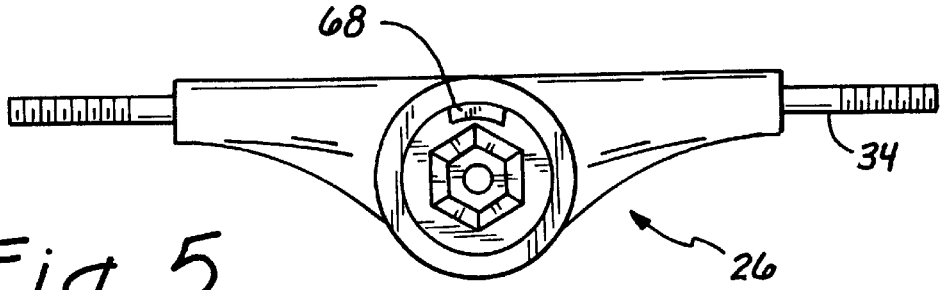
FIG. 5 is a top view of the axle bracket.
Figure 6:
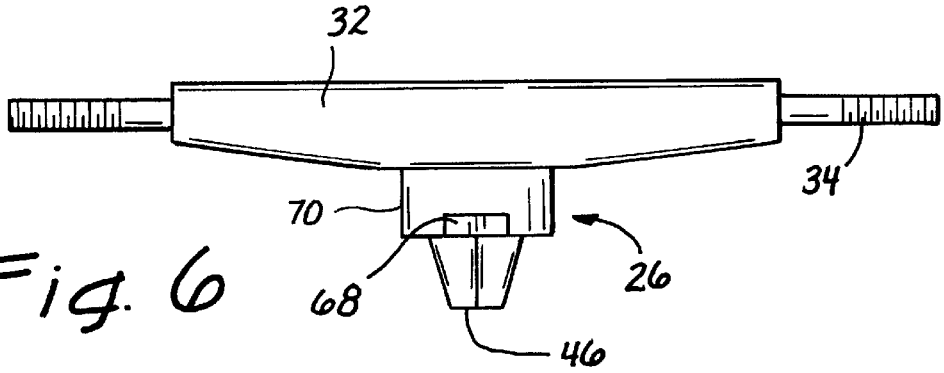
FIG. 6 is a side view of the axle bracket.

Turning specifically now to FIGS. 4, 5 and 6, the rotational lock subassembly 66 preferably includes a notch 68 defined in a shoulder 70 of the axle bracket 26 between the hexagonal tapered portion 46 and the bottom portion 32 thereof. The subassembly 66 further includes a projecting portion, or protrusion, 74 on an inner lip 76 of the housing 12, generally toward the bottom end 20. As shown most clearly in FIG. 2, the protrusion 74 is adapted to be placed in the notch 68 (see FIG. 2). A non-metallic collar 77, including a bearing surface, may be provided about the shoulder 70 to reduce metal friction between the bracket 26 and housing 12.

Preferably, the predetermined angle of rotation, when the truck assembly 10 is being used with a longboard, is an angle of about 21°. To limit the angle of rotation of the axle 34 to about 21°, the notch 68 preferably is defined by an arc of about 24.75°, cut away from the shoulder 70, and the protrusion 74 may be defined by an arc of about 3.75°.

In effect, as a rider attempts to turn the skateboard by leaning toward the side he wishes to turn toward, the axle 34 and axle bracket 26 will rotate relative to the housing and skateboard fixed thereto. During the turn, the protrusion 74 will slide within the arced notch 68, but the axle bracket 26 will be prevented from rotating further than the predetermined angle. This rotational lock subassembly feature substantially prevents "wheel bind" and contributes to a smooth ride response.

Another substantial advantage of the present skateboard assembly is that the structure hereinabove described and shown reduces stress on many components of the truck, particularly the mounting pin 38.

Turning now specifically to FIGS. 1 and 2, the mounting pin subassembly 36 includes mounting pin 38 and plate 94. The upper end portion 96 of mounting pin 38 includes a squared region 97 immediately below head portion 87. Squared region 97 is configured to be engageable within the square central through hole 101 of plate 94. Thus, with the truck assembly 10 assembled, as shown in FIG. 2, the plate 94 is positioned relative to mounting pin 38 such that a portion of squared region 97 is located within square hole 101.

Plate 94 includes diametrically opposing notches 99 which extend inwardly from the periphery of the plate. In the assembled condition, the notches 99 of plate 94 are positioned to receive inwardly extending ribs 60 of housing 12. In this position, both plate 94 and mounting pin 38 are maintained substantially stationary relative to housing 12.

As shown in FIG. 2, the mounting pin 38 is spaced apart from the inner wall 44 of the wedge member 40. FIG. 2 shows a generally annular chamber 80 defined by the mounting pin 38 and the hexagonal inner wall 44 of the wedge member 40 and inner wall of the resilient member 52. Advantageously, the mounting pin 38 is not subject to any significant stresses during turns of the skateboard.

An additional advantage of mounting pin subassembly 36 is that, in the assembled condition, as shown in FIG. 2, the plate 94 is in direct contact with resilient member 52. By applying a controlled amount of force on mounting pin subassembly 36, the resilient member 52 can be compressed to a controllable extent. Such controlled compression results in adjusting the resistence to rotation obtained from the resilient member 52. Thus, mounting pin subassembly 36 provides a very convenient way to adjust the rotation resistance of the resilient member 52 and, thereby, adjust the overall feel or response of the skateboard to turns.

Figure 3:
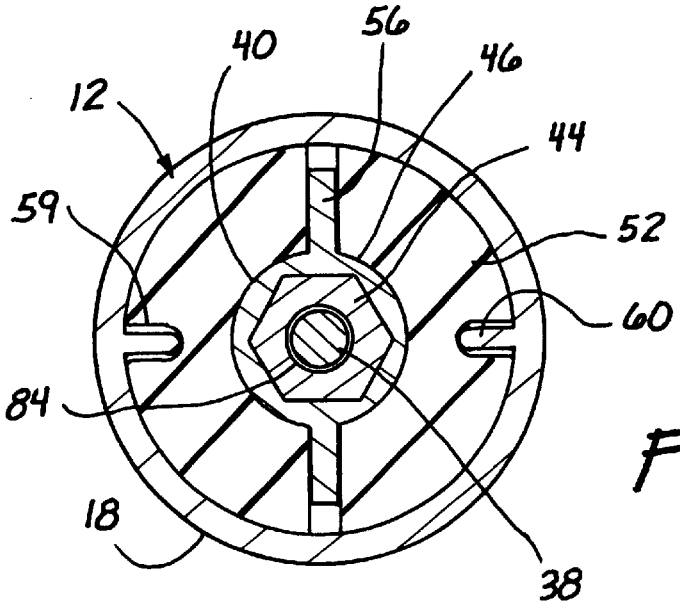
FIG. 3 is a cross sectional view of the invention taken along line 3—3 of FIG. 2.

Turning to FIG. 3, it is shown that the mounting pin 38 fits within a round, circular central aperture 84 through the axle bracket 26. The mounting pin 38 is passed through axle bracket 26 and the threaded distal end 88 of the mounting pin is fitted with a washer 89 and an adjusting nut 90.

The truck assembly 10 of the invention provides substantial advantages over conventional truck assemblies in which the mounting or king pin carries much of the load of the truck. In conventional truck assemblies, many of the truck components are directly and rigidly fastened to the mounting pin. Thus, the mounting pin is subjected to substantial stresses during turns of the skateboard. The pin may become contorted, effecting the balance and alignment of the truck. Unlike prior skateboard truck designs, when the truck of the present invention is subjected to stresses during turns and maneuvers of the skateboard, the ability of the truck to withstand these stresses does not depend on the strength of the mounting pin 36, but lies primarily in the direct mounting between the axle bracket 26 and the wedge member 40.

While the invention has been described with respect to various specific examples and embodiments, it is to be understood that the invention is not limited thereto and that it can be variously practiced within the scope of the following claims.

What is claimed is:

1. A truck assembly comprising:

a housing having a longitudinal axis, an upper end and a bottom end, said upper end adapted to be mounted to a skateboard;

an axle bracket positioned partially in the housing and extending outwardly from the bottom end of the housing for rotation transverse to the longitudinal axis, the axle bracket including a projecting upper end portion, and a bottom end portion adapted to receive a transversely extending axle and wheel assembly;

a resilient member located at least partially in the housing and adapted to resist transverse rotation of the axle bracket; and a wedge member having an aperture for receiving the projecting upper end portion of the axle bracket, the wedge member aperture and the projecting upper end portion of the axle bracket having complementary, engaging configurations.

2. The truck assembly of claim 1 further comprising a mounting pin subassembly operatively coupled to the housing and adapted for securing the housing to the axle bracket.

3. The truck assembly of claim 2 wherein the mounting pin subassembly includes a mounting pin extending substantially along the longitudinal axis of the housing and a plate member through which the mounting pin passes, the plate member being adapted to be substantially stationary relative to the housing.

4. The truck assembly of claim 3 wherein the plate member includes at least one notch and the housing includes at least one inwardly extending rib sized and adapted to be received in the at least one notch to maintain the plate member substantially stationary relative to the housing.

5. The truck assembly of claim 3 wherein the plate member has a hole through which the mounting pin passes, the hole and at least a portion of the mounting pin having complementary engaging configurations to prevent the mounting pin from rotating relative to the plate member.

6. The truck assembly of claim 1 wherein the wedge member aperture and the projecting upper portion have complementary engaging configurations.

7. The truck assembly of claim 6 wherein the wedge member aperture and the projecting upper portion have complementary engaging configurations including at least one substantially planar region.

8. The truck assembly of claim 1 wherein the wedge member includes diametrical flanges adapted to engage complementary diametrical slots in the resilient member and facilitate proper alignment between the resilient member and the axle bracket.

9. The truck assembly of claim 1 further comprising a rotational lock subassembly adapted to restrain the axle bracket from transverse rotation in excess of a predetermined angle of rotation.

10. The truck assembly of claim 9 wherein the rotational lock subassembly includes a notch in the axle bracket and a projecting portion of said housing adapted to be placed in the notch.

11. The truck assembly of claim 10 wherein the notch is defined in a shoulder of the projecting upper portion of the axle bracket.

12. A truck assembly comprising:

a housing having a longitudinal axis, an upper end and a bottom end, said upper end adapted to be mounted to a skateboard;

an axle bracket positioned in proximity to the bottom end of the housing for rotation transverse to the longitudinal axis, the axle bracket including a projecting upper portion, and a bottom end portion adapted to receive a transversely extending axle and wheel assembly;

a resilient member operatively coupled to the axle bracket and adapted to resist transverse rotation of the axle bracket; and a wedge member at least partially received within the resilient member and configured to facilitate proper alignment between the resilient member and the axle bracket, the wedge member including an aperture configured to directly couple the wedge member to the projecting upper portion of the axle bracket.

13. The truck assembly of claim 12 further comprising a mounting pin subassembly operatively coupled to the housing and adapted for securing the housing to the axle bracket.

14. The truck assembly of claim 13 wherein the mounting pin subassembly includes a mounting pin extending substantially along the longitudinal axis of the housing and a plate member through which the mounting pin passes, the plate member being adapted to be substantially stationary relative to the housing.

15. The truck assembly of claim 14 wherein the plate member includes at least one notch and the housing includes at least one inwardly extending rib sized and adapted to be received in the at least one notch to maintain the plate member substantially stationary relative to the housing.

16. The truck assembly of claim 14 wherein the plate member has a hole through which the mounting pin passes, the hole and at least a portion of the mounting pin having complementary engaging configurations to prevent the mounting pin from rotating relative to the plate member.

17. The truck assembly of claim 12 wherein the wedge member aperture and the projecting upper portion have complementary engaging configurations.

18. The truck assembly of claim 12 further comprising a rotational lock subassembly adapted to restrain the axle bracket from transverse rotation in excess of a predetermined angle of rotation.

19. A truck assembly for use with a skateboard, the assembly comprising:

a housing having a longitudinal axis, an upper end and a bottom end, said upper end adapted to be removably fastened to a skateboard;

an axle bracket positioned in proximity to the bottom end of the housing for rotation transverse to the longitudinal axis, the axle bracket including a projecting upper portion, a shoulder and a bottom end portion adapted to receive a transversely extending axle and wheel assembly;

a resilient member located at least partially in the housing and adapted to resist transverse rotation of the axle bracket; and a wedge member, received within the resilient member; and a rotational lock subassembly including a projecting portion on said housing and a notch in the axle bracket and the projection portion of the housing adapted to be placed in the notch, the subassembly being adapted to restrain the axle bracket from transverse rotation in excess of a predetermined angle of rotation.

20. The truck assembly of claim 19 further comprising a mounting pin subassembly operatively coupled to the housing and adapted for securing the housing to the axle bracket, the mounting pin subassembly including a mounting pin extending substantially along the longitudinal axis of the housing and a plate member through which the mounting pin passes, the plate member being adapted to be substantially stationary relative to the housing.

21. The truck assembly of claim 3 wherein the mounting pin extends through the wedge member aperture and is spaced-apart from the wedge member aperture.

* * * * *